US006723227B1

(12) United States Patent
Samson

(10) Patent No.: US 6,723,227 B1
(45) Date of Patent: Apr. 20, 2004

(54) FLUIDIZED CATALYTIC CRACKING PROCESS

(75) Inventor: Rene Samson, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/009,142

(22) PCT Filed: May 10, 2000

(86) PCT No.: PCT/EP00/04384

§ 371 (c)(1),
(2), (4) Date: Nov. 8, 2001

(87) PCT Pub. No.: WO00/68340

PCT Pub. Date: Nov. 16, 2000

(30) Foreign Application Priority Data

May 11, 1999 (EP) ..... 99303667

(51) Int. Cl.[7] ..... C10G 11/00

(52) U.S. Cl. ..... 208/113; 208/151; 208/150; 208/164; 208/159; 208/120; 422/144; 422/142; 422/145

(58) Field of Search ..... 422/144, 142, 422/145; 208/151, 150, 164, 159, 120, 113

(56) References Cited

U.S. PATENT DOCUMENTS 3,856,659 A 12/1974 Hartley
3,894,934 A 7/1975 Hartley
4,869,879 A * 9/1989 Hettinger ..... 422/144
5,584,986 A * 12/1996 Bartholic ..... 208/151

FOREIGN PATENT DOCUMENTS

| | | | |
|---|---|---|---|
| EP | 0 137 998 A2 | 4/1985 | ..... C10G/11/18 |
| EP | 0 236 055 A2 | 9/1987 | ..... C10G/11/18 |
| EP | 0 702 077 A2 | 3/1996 | ..... C10G/11/18 |
| WO | 90/12076 | 10/1990 | ..... C10G/11/18 |

* cited by examiner

*Primary Examiner*—Walter D. Griffin
*Assistant Examiner*—James Arnold, Jr.

(57) ABSTRACT

Fluidized catalytic cracking process which process comprises: (a) separating the hydrocarbon product from the spent catalyst by means of one or more gas-solid separation steps; (b) stripping the spent catalyst in a dense phase fluidized stripping zone by introducing a stripping medium in the lower portion of the stripping zone; (c) introducing part of the spent catalyst obtained in step (b) to a regeneration zone wherein the coke is removed from the catalyst by means of combustion; (d) introducing the remaining part of the spent catalyst and part of the hot regenerated catalyst into a lower portion of an elongated dilute phase stripping zone; (e) introducing a stream of a stripping medium into the lower portion of the dilute phase stripping zone to contact the resulting mixture of spent catalyst and regenerated catalyst therein; (f) passing a stream of the spent catalyst mixed with the hot regenerated catalyst and stripping medium in the dilute phase stripping zone; (g) introducing the separated catalyst of step (f) to the dense phase stripping zone of step (b); (h) passing the remaining part of the catalyst obtained in step (c) to the reaction zone.

9 Claims, 1 Drawing Sheet

FLUIDIZED CATALYTIC CRACKING PROCESS

Figure 1:
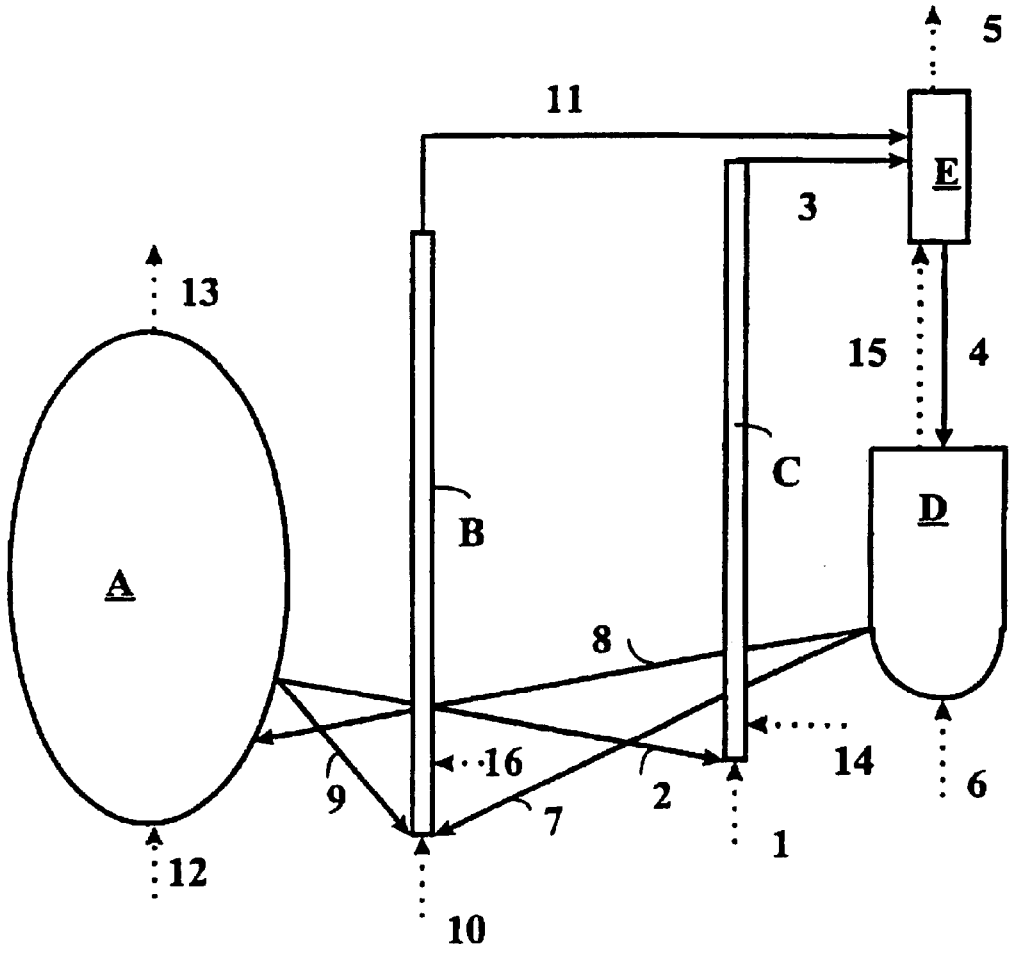

The invention is related to a fluidized catalytic cracking process which process comprises contacting a hydrocarbon feedstock with a fluidized particulate catalyst in a reaction zone wherein a hydrocarbon product is prepared and wherein coke accumulates on the catalyst to become a spent catalyst. The coke is removed in a regenerator by means of combustion and the regenerated catalyst is reused in the reaction zone.

Despite the long existence of the fluidized catalytic cracking (FCC) process, techniques are continually sought for improving product recovery both in terms of product quantity and composition, i.e. yield and selectivity. A facet of the FCC process that has received attention is the recovery by means of stripping of adsorbed products from the spent FCC catalyst. Improvement in the recovery of hydrocarbons from spent catalyst directly improves yields. Aside from increasing hydrocarbon recovery, reducing the carry-over of hydrocarbons into the regeneration zone improves the overall heat balance of the FCC unit. Hydrocarbon that enters the regeneration zone releases additional high temperature heat as it burns in the oxygen atmosphere. Any additional heat release in the regenerator may interfere with the regenerator operation by unduly raising temperatures in the regeneration zone or requiring cooling methods to maintain a suitable temperature.

The processing of increasingly heavier feeds and the tendency of such feeds to elevate coke production makes the control of regenerator temperatures difficult. The increase in coke on spent catalyst results in a larger amount of coke being burned in the regenerator per ton of catalyst circulated. Heat is removed from the regenerator in conventional FCC units in the flue gas, and principally in the hot regenerated catalyst stream. An increase in the level of coke on spent catalyst will increase the temperature difference between the reactor and the regenerator, and the regenerated catalyst temperature. A reduction in the amount of catalyst circulated is, therefore, necessary in order to maintain the same reactor temperature. However, the lower catalyst circulation rate required by the higher temperature difference between the reactor and the regenerator will lower hydrocarbon conversion.

By improving the efficiency of the stripping process less adsorbed hydrocarbons in addition to the fixed coke will be present on the catalyst supplied to the regenerator, resulting in a decrease in the temperature difference between the reactor and the regenerator. Various possible methods have been developed to increase the efficiency of the stripping process. For example European patent specification EP-A-702077 describes a more efficient stripping process. In this process the catalyst is first stripped in a conventional dense phase stripping zone followed by stripping in a dilute phase stripping zone. The thus stripped catalyst, after being separated from the stripping medium, is sent to the regenerator. In the dilute phase stripping zone the spent catalyst is mixed with some hot regenerated catalyst resulting in that the stripping temperature and thus the stripping efficiency is increased.

European patent specification EP-A-322276 describes a comparable process as described in EP-A-702077. As an additional feature oxygen is present in the lift gas of the dilute phase stripping zone.

U.S. Pat. No. 3,856,659 discloses a FCC process wherein part of the spent catalyst is mixed with part of the regenerated catalyst. This mixture is contacted with steam in a dense fluidized bed. The catalyst mixture is subsequently supplied to a riser reactor in which reactor the catalyst mixtures undergoes at least partial regeneration by burning off carbonaceous deposits.

U.S. Pat. No. 3,894,934 discloses a FCC process comprising a first and second elongated riser reactor, a dense phase fluidized stripping zone and a catalyst regenerator. The process comprises a step wherein part of the catalyst obtained directly after separation from a hydrocarbon product as obtained in the first riser reactor is supplied to the second riser reactor. To this second riser reactor a hydrocarbon feedstock and part of the regenerated catalyst is also supplied.

The following process according to the invention provides an even more efficient method of stripping the spent catalyst: Fluidized catalytic cracking process which process comprises contacting a hydrocarbon feedstock with a fluidized particulate catalyst in a reaction zone wherein a hydrocarbon product is prepared and wherein coke accumulates on the catalyst to become a spent catalyst and which process comprises of the following steps:

(a) separating the hydrocarbon product from the spent catalyst by means of one or more gas-solid separation steps;

(b) stripping the spent catalyst in a dense phase fluidized stripping zone by introducing a stripping medium in the lower portion of the stripping zone;

(c) introducing part of the spent catalyst obtained in step (b) to a regeneration zone wherein the coke is removed from the catalyst by means of combustion;

(d) introducing the remaining part of the spent catalyst obtained in step (b) and part of the hot regenerated catalyst obtained in step (c) into a lower portion of an elongated dilute phase stripping zone;

(e) introducing a stream of a stripping medium into the lower portion of the dilute phase stripping zone to contact the resulting mixture of spent catalyst and regenerated catalyst therein;

(f) passing a stream of the spent catalyst mixed with the hot regenerated catalyst and stripping medium upwardly in the dilute phase stripping zone under dilute phase stripping conditions to an upper portion thereof;

(g) separating substantially all of the spent catalyst and regenerated catalyst from the effluent of step (f) and introducing the separated catalyst to the dense phase stripping zone of step (b);

(h) passing the remaining part of the hot regenerated catalyst obtained in step (c) to the reaction zone to be contacted with the hydrocarbon feedstock.

It has been found that with the process according to the invention a more efficient stripping method is obtained because a higher temperature in the dense phase stripping zone can be achieved. This because the catalysts leaving the dilute phase stripping zone, having a more elevated temperature than the catalyst leaving the reaction zone, are also supplied to the dense phase stripping zone. Because a more efficient stripping process is achieved less absorbed hydrocarbons will enter the regeneration zone resulting in a regenerated catalyst having a lower temperature than possible with the prior art processes. This gives the operator of the FCC process the possibility to increase the amount of regenerated catalyst to be used in the reaction zone, resulting in a higher conversion while maintaining the quality of the products thus obtained. Further advantages of the invention will become apparent from the below detailed description of the invention.

The hydrocarbon feedstock include conventional FCC feeds and higher boiling or residual feeds. The most common of the conventional FCC feeds is a vacuum gas oil which is typically a hydrocarbon material having a boiling range of from 350–530° C. Vacuum gas oils are the distillate fraction obtained by vacuum distillation of a atmospheric residue fraction, which are in turn obtained from distilling a crude petroleum feedstock at atmospheric pressure. The process according to the present invention is especially suitable for processing heavier hydrocarbon feedstocks than vacuum gas oils like for example the atmospheric residue fraction directly.

The invention will be illustrated by making use of FIG. 1. FIG. 1 represents a schematic representation of a FCC unit in which the process according to the invention can be performed. The solid lines represent flows comprising catalysts and the broken lines represent flows which do not contain significant amounts of catalyst, like gaseous flows or liquid hydrocarbon flows. In FIG. 1 a fluidized catalytic cracking unit is shown comprising a reactor riser (C) having means (14) to supply a hydrocarbon feedstock, conduit means (2) to receive regenerated catalyst from regeneration zone (A) and optionally means (1) to receive a lift gas. The reactor effluent is sent via conduit means (3) to separation means (E). Catalyst, as separated from the hydrocarbon product in separation means (E), is sent via means (4) to the dense phase fluidized stripping zone (D). Via means (5) the hydrocarbon product as separated from the reactor effluent in separation means (E) is sent to a downstream unit operation. To the dense phase stripping zone (D) a stripping medium is supplied via supply means (6). Via means (15) the gaseous effluent of the dense phase stripping zone (D) is preferably sent to separation means (E) in order to separate any catalyst particles present in (15). Via conduit means (7) spent catalyst is sent from dense phase stripping zone (D) to the dilute phase stripping zone (B). Via conduit means (8) the remaining spent catalyst is sent from dense phase stripping zone (D) to regeneration zone (A). Via conduit means (9) part of the regenerated catalyst is sent to dilute phase stripping zone (B). Via supply means (10) a stripping medium is supplied to dilute phase stripping zone (B). Via conduit means (11) the effluent of dilute phase stripping zone (B) is sent to separation means (E). Via supply means (12) an oxygen containing gas is supplied to regeneration zone (A). Via conduit means (13) the combustion gases leave the regenerator.

Below the process according to the invention will be explained in more detail. Use shall be made to the reference numbers of FIG. 1 to indicate the location of the described stream, feedstock or product in the FCC unit of FIG. 1.

The reaction zone (C) of the fluidized catalytic cracking process of this invention is suitably an elongated tube like reactor in which hot catalyst (2) and hydrocarbon feedstock (14) are co-currently contacted. Optionally a lift gas (1) is used, for example steam. The tube like reactor will normally be a vertical reactor in which the reactants and catalyst flow in an upward direction. Such a reactor is also referred to as a riser reactor. Embodiments in which the reactants and catalyst flow in a downward direction are also possible as well as combinations of downward and upward flow. The conditions in the riser reactor may vary between those conventionally applied and the more severe conditions. For example conventional catalyst to hydrocarbon feed ratios (also referred to as catalyst/oil ratio) are suitably between 4 and 11 weight/weight, while the catalyst/oil ratio under more severe conditions can be as high as 200, and more suitably as high as 100. Conventional temperatures in the riser will suitably be between 480 and 550° C. and preferably between 500 and 540° C., while the temperature under more severe conditions may be higher than 550° C. and ranging even up to 600° C. The temperature will depend on the temperature of the regenerated catalyst (2) which is recycled to the reaction zone (C) in step (h). The residence time in the riser may be between 0.1 and 5 seconds. The catalyst used in the present process can be for example conventional FCC catalyst as for example described in "Fluid catalytic cracking: Science and Technology", Ed. Magee J. S., Mitchell M. M. Jr.,1993, Elsevier Science Publishers B. V., pages 1–6.

Separating the hydrocarbon product from the spent catalyst (3) in step (a) is performed by means of one or more gas-solid separation steps (E). Step (a) can be performed by conventional separation means which are known to separate FCC catalyst from the hydrocarbon product. The most suitable and widely used gas-solid separation steps are cyclone separators. Preferably the gas is separated from the spent catalyst in one or more primary cyclone separators and wherein the partly cleaned gas obtained is further cleaned in one or more secondary cyclone separators. The separated spent catalyst (4) is sent to step (b). The separation means in step (a) may form an integrated part with the dense phase stripping zone (D). Suitable configurations are that the primary cyclone(s) and optionally also the secondary cyclone(s) are placed above the dense phase stripping zone (D) within the same vessel. Configurations having secondary and optionally also primary cyclone separators external of the vessel comprising the stripping zone (D) are also possible.

Stripping the spent catalyst in a dense phase fluidized stripping zone (D) in step (b) is performed by introducing a stripping medium (6) in the lower portion of the stripping zone (D). The stripping medium (6) is suitably steam. In this step (b) most of the adsorbed hydrocarbons present in the spent catalyst particles are removed from the catalyst. The steam and hydro-carbons (15) thus recovered are suitably combined with the hydrocarbon product stream (5). Combining these streams can be achieved before step (a), during step (a), for example by combining the steam/hydrocarbon mixture with the gas leaving a primary cyclone separator or after step (a). Preferably the steam/hydrocarbon mixture (15) is combined with the hydrocarbon product before or during step (a) in order to separate any catalyst particles present in the steam/hydrocarbon mixture (15). The stripping zone (D) is performed as a dense phase fluidized bed. Suitable superficial gas velocities are between 0.1 and 1 m/s and preferably between 0.2 and 0.4 m/s. The stripping zone (D) may be equipped with internals to enhance staging and contact between the gas catalyst. The temperature in the stripping bed (D) can be higher than in the state of the art stripping zones. The temperature in a stripping zone of a prior art process will be about equal to the temperature of the spent catalyst leaving the reactor. In the present process also regenerated catalyst from step (f), and via steps (g) and (a) are fed (via 11) to the dense phase stripping zone. Because catalyst (present in 11) from step (f) has a higher temperature than spent catalyst (present in 3) a higher temperature will be achievable in the dense phase stripping zone (D). This is very advantageous because a higher temperature enhances the stripper efficiency in the dense phase stripping zone (0) as explained above. Suitable and practical achievable temperatures in the dense phase stripping zone (D) are between 480 and 700° C. and preferably between 500 and 600° C.

In step (c) part of the spent catalyst obtained in step (b) are introduced (via (8)) to a regeneration zone (A) wherein the coke is removed from the catalyst by means of combustion.

The regeneration may be performed under conventional process conditions and in conventionally used process equipment. The coke is removed from the spent catalyst by means of combustion. For achieving combustion, oxygen-containing gas (12) is fed to the regenerator (A). Residence time in the regenerator (A) will usually provide sufficient reaction time to completely or partly combust coke and fully regenerate the catalyst i.e., removal of coke to suitably less than 0.4 wt %. The temperature of the regenerated catalyst (2) is suitably between 640 and 800° C. In step (h) the part of the hot regenerated catalyst (2) which is not passed to step (d) is passed to the reaction zone (C) to be contacted with the hydrocarbon feed-stock (14). Step (h) may be performed by well know methods.

In step (d) the remaining part of the spent catalyst (7) obtained in step (b) and part of the hot regenerated catalyst (9) obtained in step (c) are introduced into a lower portion of an elongated dilute phase stripping zone (B). The weight ratio of spent catalyst (8) obtained in step (b) which is sent to the regenerator (step (c)) and of spent catalyst (7) obtained in step (b) which is sent to the dilute phase stripping zone (B) is suitably between 1:10 and 10:1. The weight ratio of spent catalyst (7) and regenerated catalyst (9) which are contacted in the dilute phase stripping zone (B) are suitably between 1:10 and 10:1.

In step (e) a stream of a stripping medium (10) is introduced into the lower portion of the dilute phase stripping zone (B). A suitable stripping medium is steam. Steam may optionally be mixed with some oxygen or oxygen containing gases such as air. Oxygen will react with the coke and adsorbed hydrocarbons present on the spent catalyst thereby generating extra heat and thus a higher stripping temperature in the dilute phase stripping zone (B). As a result of these higher temperatures in the dilute phase stripping zone (B) higher temperatures in the dense phase stripping zone (D) will be achieved. As explained before a higher temperature in these stripping zones is favourable for the stripping efficiency. For safety reasons the amount of oxygen should be kept below well determined limits. A nearly complete consumption of oxygen has to take place in the dilute phase stripping zone (B).

In step (f) a stream of the spent catalyst (7) mixed with the hot regenerated catalyst (9) and stripping medium (10) is passed upwardly in the dilute phase stripping zone (B) under dilute phase stripping conditions to an upper portion thereof. Dilute phase stripping conditions are achieved when the velocity of the stripping medium (10) in the stripping zone (B) are high enough to carry the solids in an upward directions resulting in a pneumatic conveying of the catalyst particles. The superficial gas velocity is preferably higher than 1 m/s, and more preferably between 2 and 30 m/s. The dilute phase stripping zone (B) is preferably a vertical riser reactor having preferably a length to diameter ratio (L/D) of between 10 and 300 and more preferably between 15 and 100.

In step (g) substantially all of the spent catalyst is separated from the effluent (11) of step (f), comprising hydrocarbons and stripping medium. Separation may be performed by well known means, like in cyclone separators. Preferably the separation takes place in the gas-solid separation steps, means (E), of step (a). This is advantageous because the separated catalyst will then be introduced into the dense phase stripping zone (D) together (via (4)) with the catalyst separated from the hydrocarbon product (3) leaving the reaction zone (C).

An additional advantage of the present process is that existing FCC units can be easily modified to obtain a unit,capable of performing the process according to the invention. Preferably existing FCC units which are equipped with a so-called external riser reactor are modified according to this method. Examples of such units are described in Hydrocarbon Processing, November 1998. Exemplified are the ABB Lummus design on page 78, The Kellogg Brown design on page 80 and the Shell External Reactor Design on page 81. By simply adding a dilute phase stripping zone (B) and the required conduits (7, 9, 10, 11) and increasing the capacity of the existing dense phase stripping zone (D) of a FCC unit having an external riser (C) a FCC unit is obtained which is capable of performing the process according to the invention. The advantage of retrofitting units having an external riser is that the conduit connecting the downstream end of the dilute phase stripping zone can be easily connected with the separation means of existing step (a).

Preferably the dilute phase stripping zone (B) is also provided with supply means (16) to supply a hydrocarbon feedstock. The elongated riser of zone (B) can then be simply used as a second reaction zone in a different mode of operation. This may be advantageous when less heavier feedstocks are processed and the need for more efficient stripping is not that apparent. The two reaction zones can then be advantageously be used to prepare an additional amount of lower olefins in addition to the normal FCC products by using two different feedstocks. One feedstock may be the conventional FCC feedstock, like vacuum gas oil, while the feedstock processed in the second reaction zone is preferably a mixture of steam and a lighter feedstock, boiling below 300° C., like for example the naphtha fraction obtained in the FCC process itself. When using the FCC unit in this mode of operation no or almost no spent catalyst (7) will be supplied to the additional reaction zone. When the riser used as the dilute phase stripping zone (B) is used in an alternating mode as an additional reaction zone, then preferably the riser is equipped with internals as for example described in U.S. Pat. No. 5,851,380.

Configurations of possible reaction zones, dense phase fluidized stripping zones and regeneration zones are for example described in the above mentioned patent publications and in "Fluid catalytic cracking: Science and Technology", Ed. Magee J. S., Mitchell M. M. Jr.,1993, Elsevier Science Publishers B.V., pages 385–393.

The invention shall be illustrated by the following non-limiting examples. Use shall be made of the references used in FIG. 1.

EXAMPLE 10.000 t/day of a mixture of a vacuum gas oil and a residue was mixed with 52 t/min of a regenerated catalyst contacted in a riser (C). The temperature in the riser was kept a constant value of 520° C., which related to a desired octane number of the gasoline product. The catalyst was separated from the hydrocarbon product making use of a primary and secondary cyclone. The separated catalyst at a rate of 52 t/min was combined with 48 t/min of catalyst obtained in the dilute phase stripper (B), which catalyst had a temperature of 580° C. The resulting temperature in the dense phase stripper was 549° C. Of the 100 t/min of spent catalyst leaving the dense phase stripper (D) 38 t/min was sent to dilute phase stripper (B) and 62 t/min was sent to regenerator (A). To dilute phase stripper (B) 12 t/min of regenerated catalyst having a temperature of 680° C. was sent. Steam was used in both the dilute and dense phase strippers.

COMPARATIVE EXPERIMENT

Example 1 was repeated except that the effluent of dilute phase stripper (B) was sent to regenerator (A) as in EP-A-

702077. The cat recirculation rate to the reactor (C) was adjusted so that the desired temperature of 520° C. was achieved in the riser (C) resulting in the same octane number for the gasoline produced as in Example 1. In Table 1 a comparison is given between the example according the invention and this experiment.

TABLE 1

| | Comparative Experiment | Example |
|---|---|---|
| Dense phase stripping temperature (° C.) | 520 | 549 |
| Regenerator temperature (° C.) | 707 | 701 |
| Cat. circulation rate (t/min) stream (2) | 50 | 52 |
| Conversion(*) (wt %) | 70 | 70.4 |

(*)conversion is defined as the weight percentage of feed converted to products boiling below 221° C. plus the weight percentage of coke.

As can be seen from the results in Table 1 a lower is regeneration temperature results from the more efficient stripping method of the invention. As a result a higher catalyst circulation rate (tons of catalyst sent to the reaction zone (C)) was possible in the Example according to the invention, which in turn resulted in a higher conversion.

What is claimed is:

1. Fluidized catalytic cracking process which process comprises contacting a hydrocarbon feedstock with a fluidized particulate catalyst in a reaction zone wherein a hydrocarbon product is prepared and wherein coke accumulates on the catalyst to become a spent catalyst and which process comprises of the following steps:

(a) separating the hydrocarbon product from the spent catalyst by means of one or more gas-solid separation steps;

(b) stripping the spent catalyst in a dense phase fluidized stripping zone by introducing a stripping medium in the lower portion of the stripping zone;

(c) introducing part of the spent catalyst obtained in step (b) to a regeneration zone wherein the coke is removed from the catalyst by means of combustion;

(d) introducing the remaining part of the spent catalyst obtained in step (b) and part of the hot regenerated catalyst obtained in step (c) into a lower portion of an elongated dilute phase stripping zone;

(e) introducing a stream of a stripping medium into the lower portion of the dilute phase stripping zone to contact the resulting mixture of spent catalyst and regenerated catalyst therein;

(f) passing a stream of the spent catalyst mixed with the hot regenerated catalyst and stripping medium upwardly in the dilute phase stripping zone under dilute phase stripping conditions to an upper portion thereof;

(g) separating substantially all of the spent catalyst and regenerated catalyst from the effluent of step (f) and introducing the separated catalyst to the dense phase stripping zone of step (b);

(h) passing the remaining part of the hot regenerated catalyst obtained in step (c) to the reaction zone to be contacted with the hydrocarbon feedstock.

2. The process of claim 1, in which the temperature in the dense phase stripping zone is between about 500° C. and about 600° C.

3. The process of claim 1, in which the weight ratio of spent catalyst obtained in step (b) which is sent to step (c) and of spent catalyst obtained in step (b) which is used in step (d) is between about 1:10 and about 10:1.

4. The process of claim 1, in which the weight ratio of spent catalyst and regenerated catalyst in step (d) is between about 1:10 and about 10:1.

5. The process of claim 1, in which the separation of step (g) is performed in the gas-solid separation steps of step (a).

6. Fluidized catalytic cracking unit comprising a reactor riser (C) having means to receive a hydrocarbon feedstock (14) and regenerated catalyst (2) and optionally a lift gas (1), a conduit means (3) to send the reactor effluent to a separation means (E), means (4) to send catalyst from separation means (E) to a dense phase stripping zone (D), means (5) to send a hydrocarbon product as separated from the reactor effluent in separation means (E) to a downstream unit operation, supply means (6) to feed a stripping medium to the dense phase stripping zone (D), means (15) to supply the gaseous effluent of the dense phase stripping zone (D) to separation means (E) in order to separate any catalyst particles present in this gaseous effluent, conduit means (7) to send spent catalyst from dense phase stripping zone (D) to the elongated diluent phase stripping zone (B), conduit means (8) to send spent catalyst from dense phase stripping zone (D) to regeneration zone (A), conduit means (9) to send regenerated catalyst to dilute phase stripping zone (B), supply means (10) to supply a stripping medium to dilute phase stripping zone (B), conduit means (11) to send the effluent of dilute phase stripping zone (B) to separation means (E), supply means (12) to supply an oxygen containing gas to regeneration zone (A) and conduit means (13) for the combustion gases to leave the regenerator.

7. Unit as described in claim 6, wherein additional supply means (16) for introducing a hydrocarbon feedstock are present in the lower portion of the elongated dilute phase stripping zone (B).

8. A method of using the unit as described in claim 6, said method comprises:

supplying a first hydrocarbon feedstock to said means to receive a hydrocarbon feedstock.

9. A method of using the unit as described in claim 7, said method comprising:

supplying a second hydrocarbon feedstock to said additional supply means for introducing a hydrocarbon feedstock.

* * * * *